US010040589B2

(12) United States Patent
Owens

(10) Patent No.: US 10,040,589 B2
(45) Date of Patent: Aug. 7, 2018

(54) VACUUM SEALER WITH A SOLID STATE PROXIMITY DETECTOR

(71) Applicant: Sunbeam Products, Inc., Boca Raton, FL (US)

(72) Inventor: David Owens, Boynton Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 438 days.

(21) Appl. No.: 14/763,935

(22) PCT Filed: Jan. 28, 2014

(86) PCT No.: PCT/US2014/013356
§ 371 (c)(1),
(2) Date: Jul. 28, 2015

(87) PCT Pub. No.: WO2014/117141
PCT Pub. Date: Jul. 31, 2014

(65) Prior Publication Data

US 2015/0367973 A1 Dec. 24, 2015

Related U.S. Application Data

(60) Provisional application No. 61/757,330, filed on Jan. 28, 2013.

(51) Int. Cl.
*B65B 57/02* (2006.01)
*B65B 31/02* (2006.01)
*B65B 31/04* (2006.01)

(52) U.S. Cl.
CPC ..... *B65B 57/02* (2013.01); *B65B 31/024* (2013.01); *B65B 31/048* (2013.01)

(58) Field of Classification Search
CPC ..... B65B 31/048
See application file for complete search history.

(56) References Cited

U.S. PATENT DOCUMENTS 3,318,066 A * 5/1967 Seragnoli ..... B65B 51/06 53/389.1
3,869,842 A * 3/1975 Verbeke ..... B65B 51/148 156/579

(Continued)

FOREIGN PATENT DOCUMENTS

KR 20060014234 A * 2/2006
KR 101235844 B1 * 2/2013 ..... B65B 31/048
WO WO 2011101190 A1 * 8/2011 ..... B65B 31/043

*Primary Examiner* — Stephen F Gerrity
(74) *Attorney, Agent, or Firm* — Husch Blackwell LLP

(57) ABSTRACT

Systems (200) and methods (800) for causing certain operations to be performed by a Vacuum Packaging Appliance ("VPA"). The methods comprising: detecting when container material is at least partially disposed within a transparent vacuum chamber of the VPA using a proximity sensor mechanism; communicating a signal from the proximity sensor mechanism to an electronic circuit of the VPA in response to the detection of the container material within the vacuum chamber; and triggering a performance of a first operation by the VPA in response to the reception of the signal by the electronic circuit. The first operation is selected from the group comprising mechanical clamping operations to clamp the container material in position, vacuum operations to extract fluid from within a container defined by the container material, and heat sealing operations to create a heat seal along an open end of the container.

16 Claims, 7 Drawing Sheets

(56) References Cited

U.S. PATENT DOCUMENTS

| | | | | |
|---|---|---|---|---|
| 3,995,791 | A * | 12/1976 | Schoppee | B65H 19/1852 53/389.4 |
| 4,098,049 | A * | 7/1978 | Jackson et al. | B65B 57/06 206/205 |
| 4,996,819 | A * | 3/1991 | Davis | B65B 57/04 53/389.4 |
| 5,177,937 | A * | 1/1993 | Alden | B65B 51/146 53/374.8 |
| 5,272,853 | A * | 12/1993 | Francioni et al. | B65H 19/10 53/389.3 |
| 6,539,689 | B1 | 4/2003 | Yoshimoto | |
| 2003/0046907 | A1 | 3/2003 | Costello | |
| 2004/0060262 | A1 | 4/2004 | Harges et al. | |
| 2005/0022473 | A1* | 2/2005 | Small et al. | B65B 51/148 53/434 |
| 2005/0205455 | A1* | 9/2005 | Harrison | B65B 31/046 206/524.8 |
| 2006/0254219 | A1* | 11/2006 | Alipour et al. | B65B 31/046 53/434 |
| 2009/0293425 | A1* | 12/2009 | Carter et al. | B65B 57/02 53/167 |
| 2010/0095638 | A1* | 4/2010 | Zakowski et al. | B65B 31/046 53/433 |
| 2011/0126986 | A1* | 6/2011 | Cheung | B65B 31/048 156/350 |
| 2013/0340389 | A1* | 12/2013 | Harder | B65B 31/048 53/405 |
| 2014/0094354 | A1* | 4/2014 | Lam | B65H 26/02 493/37 |
| 2014/0116003 | A1* | 5/2014 | Hammad | B65B 31/048 53/376.3 |

* cited by examiner

VACUUM SEALER WITH A SOLID STATE PROXIMITY DETECTOR

CROSS-REFERENCE TO RELATED APPLICATIONS

The present application claims priority to U.S. Provisional Patent Application No. 61/757,330 filed on Jan. 28, 2013.

BACKGROUND OF THE INVENTION

Statement of the Technical Field

The inventive arrangements relate to Vacuum Packaging Appliances ("VPA"). More particularly, the invention concerns VPA employing solid state proximity detectors for detecting when a container is inserted into the VPA.

Description of the Related Art

Various appliances are used for vacuum packaging purposes to protect perishables and other products against oxidation. Such appliances typically use heat sealing elements to form seals at open ends of containers. The heat sealing elements can include one heat sealing bar or two adjacent heat sealing bars over which an open end of a container is placed. Prior to formation of a heat seal, a container may be evacuated of excess moisture and air through the use of at least one vacuum pump. The evacuation of moisture and air from the container minimizes the spoiling effects of oxygen on perishables and other products.

Such appliances may also comprise a means for detecting when the container is properly inserted therein. The means typically comprise mechanical flags configured to initiate the recognition that a container has been inserted into the respective appliance. For example, at least one mechanical structure (e.g., pendulums and springs) is provided within the appliance to detect whether a container material is inserted properly within the appliance (e.g., across a majority of an entire length of a vacuum chamber trough). Such detection occurs when at least a portion of the mechanical structure is caused to move. Movement of a mechanical flag is accomplished by inserting more bag material into the appliance.

Despite the advantages of the mechanical flag approach to detect when container material is inserted properly into a vacuum appliance, it suffers from certain drawbacks. For example, the mechanical structure could cause container material to wrinkle, thereby resulting in a false detection or other error. Also, the mechanical structures of this approach are relatively mechanically complex and expensive.

SUMMARY OF THE INVENTION

The present invention concerns apparatus and methods for causing certain operations to be performed by a VPA. The methods comprise detecting when container material is at least partially disposed within a transparent vacuum chamber of the VPA using a proximity sensor mechanism. This detection can be performed in response to a lid of the VPA being locked in a closed position. Next, a signal is communicated from the proximity sensor mechanism to an electronic circuit of the VPA in response to the detection of the container material within the vacuum chamber. In response to the reception of the signal by the electronic circuit, the performance of a first operation by the VPA is triggered. The first operation can be selected from the group comprising at least one of mechanical clamping operations to clamp the container material in position; vacuum operations to extract fluid from within a container defined by the container material; lock releasing operations to allow actuation of a cutting device; heat sealing operations to create a heat seal along an open end of the container; and lowering operations to transition a cutting device from a retracted position into a cutting position.

In some scenarios, the VPA has an automatic dispensing feature. As such, the methods may further comprise automatically dispensing container material from a roll of container material disposed in the VPA. The proximity sensor mechanism can further detect when an amount of container material contained on a roll disposed within the VPA is at or below a certain level. When such detection is made, at least one of the following operations can be performed by the VPA: suspend automatic dispensing operations; and release a lock locking a lid of the VPA in a closed position.

In these and other scenarios, the proximity sensor mechanism may be disposed within the VPA at a location (1) between a roll of container material and a vacuum trough or (2) between a front panel and the vacuum trough. Additionally, the proximity sensor mechanism can comprise: an emitter configured to emit light in proximity to and in a direction towards a vacuum chamber of the VPA; and a detector configured to detect the light reflected from the container material disposed in the VPA.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
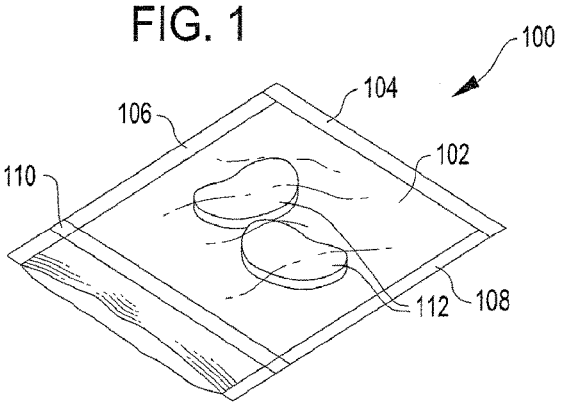
FIG. 1 is a schematic illustration of an exemplary container that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects as illustrative. The scope of the invention is, therefore, indicated by the appended claims. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout, this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may but do not necessarily, all refer to the same embodiment.

As used in this document, the singular form "a", "an", and "the" include plural references unless the context clearly dictates otherwise Unless defined otherwise, all technical and scientific terms used herein have the same meanings as commonly understood by one of ordinary skill in the art. As used in this document, the term "comprising" means "including, but not limited to".

The present invention generally concerns systems and methods for causing certain operations to be performed by a VPA. The methods comprise detecting when container material is at least partially disposed within a transparent vacuum chamber of the VPA using a proximity sensor mechanism. This detection can be performed in response to a lid of the VPA being locked in a closed position. Next, a signal is communicated from the proximity sensor mechanism to an electronic circuit of the VPA in response to the detection of the container material within the vacuum chamber. In response to the reception of the signal by the electronic circuit, the performance of a first operation by the VPA is triggered. The first operation can be selected from the group comprising at least one of: mechanical clamping operations to clamp the container material in position; vacuum operations to extract fluid from within a container defined by the container material; lock releasing operations to allow actuation of a cutting device; beat sealing operations to create a heat seal along an open end of the container; and lowering operations to transition a cutting device from a retracted position into a cutting position.

Notably, the present invention has certain advantages over conventional VPAs. For example, VPAs employing the mechanical flag approach described in the background section of this document suffers from certain drawbacks. For example, the mechanical flag structure could cause container material to wrinkle, thereby resulting in a false detection or other error. Such false detection has been eliminated by the present invention since the proximity sensor is never in contact with the container material. Also, the mechanical structures of the conventional mechanical flag approach are relatively mechanically complex and expensive, as compared to the proximity sensor mechanism of the present invention.

Embodiments will now be described with respect to FIGS. 1-8. Embodiments generally relate to VPAs configured to seal perishables or other products within a container. An example container 100 comprising at least one seal formed along an edge thereof is provided in FIG. 1. The container can include, but is not limited to a plastic bag 102 with one or more seals 104, 106, 108, 110 formed on edges thereof. At least one of the seals 110 is formed by a VPA. If less than all of the seals are formed by the VPA, then the remaining seals may have been pre formed at a factory. In all cases, perishables 112 or other products may be disposed in the container 100 for protection against oxidation.

An exemplary architecture 200 for a VPA is provided in FIGS. 2-6. VPA 200 is generally configured to evacuate and seal a container (e.g., container 100 of FIG. 1). VPA 200 may also be configured to dispense a material that can be used to form the container. In this case, VPA 200 comprises a base 210 with a storage compartment 302 formed therein. The storage compartment 302 is provided for at least partially housing a roll 304 of flexible container material. In some scenarios, the flexible container material comprises a multilayer plastic material with at least two edges having preformed seals therealong (e.g., seals 106 and 108 of FIG. 1). The roll 304 may be stored in the storage compartment 302 with or without any support mechanisms. In both cases, the roll 304 is free to at least rotate within compartment 302.

A pivoting lid 202 is hingedly coupled to the base 210 of the VPA 200. In this regard, the pivoting lid 202 can be transitioned between a closed position shown in FIG. 2 and an open position shown in FIG. 3. A user may manually cause such a transition using a lip 212 formed on an exterior front edge of the lid 202. The lip 212 allows the user to easily grasp and pivot the lid 202 about its pivot point for transitioning the lid to and from its closed position or its open position. The pivot point is defined by the hinge(s) (not shown) pivotally coupling a rear bottom edge 314 of the lid 202 to the base 210.

The lid 202 may be locked into the closed position via a latch mechanism 316, 318, 320. The latch mechanism comprises a depressible lever 316 and two hooks 318, 320 configured to engage latch cams (not shown) disposed in the base 210. In this regard, the latch cams are accessible to the hooks 318, 320 via apertures 322, 342 formed in the base 210. Notably, the hooks 318, 320 are sized and shaped to pass through respective apertures 322, 342 when the lid 202 is pivoted in the direction of arrow 324 into the closed position. The lever 316 allows a user to cause the hooks 318, 320 to lockingly engage the latch cams so that the lid 202 is locked into its closed position. The hooks can be disengaged from the latch cams automatically by the VPA 200 or manually by the user via the lever 316. In the manual scenario, the lever locks the latch mechanism when moved in a downward direction and unlocks the latch mechanism when moved in an upward direction.

Figure 2:
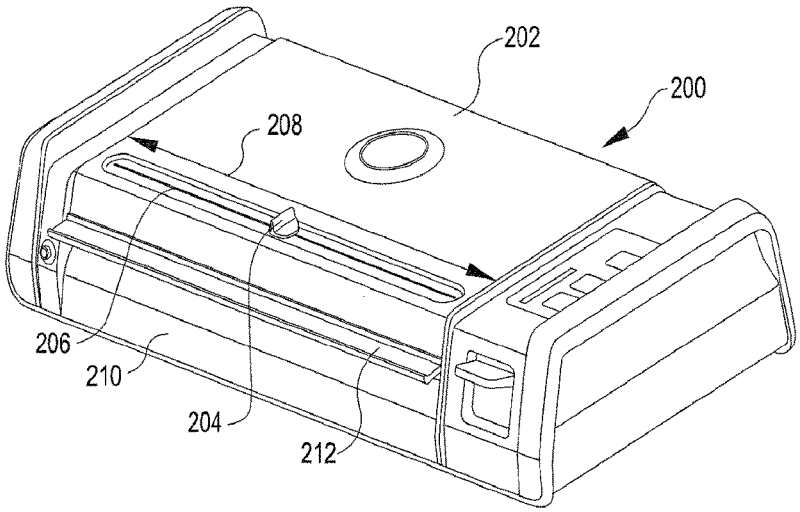
FIG. 2 is a perspective view of an exemplary VPA that is useful for understanding the present invention.
Figure 3:
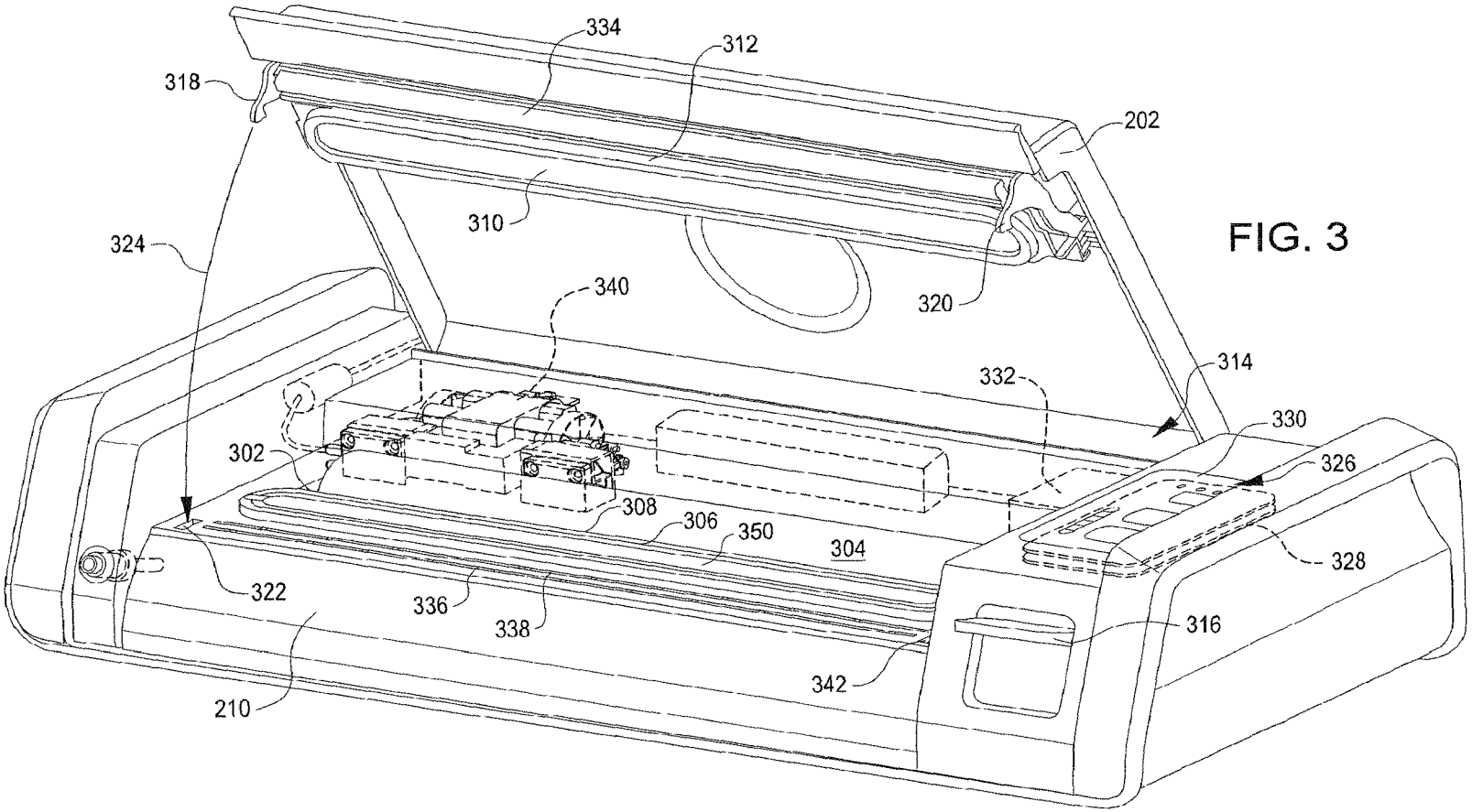
FIG. 3 is a perspective view of the exemplary VPA of FIG. 2 with a lid in an open position.

When the pivoting lid 202 is in its closed position, it encloses the roll 304 within the storage compartment 302, as shown in FIG. 2. Also, container material can be automatically dispensed from the storage compartment 302 into a vacuum chamber of the VPA 200. Additionally or alternatively, the pivoting lid 202 can allow a section of container material to be manually dispensed from the storage compartment 302 when it is in its open position, as shown in FIG. 3. Once at least a portion of the container material is dispensed from the storage compartment 302, the pivoting lid 202 can be returned to its locked closed position.

In automatic dispensing scenarios, a proximity sensor mechanism 460, 462 can be provided to perform certain operations subsequent to the placement of the pivoting lid 202 in its locked closed position. The proximity sensor mechanism 460, 462 will be described in detail below. Still, it should be understood that the proximity sensor mechanism 460, 462 can detect when the roll 304 is running out of container material (e.g., the amount of container material contained on the roll is at or falls below a certain level). Upon such detection, the proximity sensor mechanism 460, 462 can generate and communicate a signal to electronic circuitry of the VPA 200 so as to trigger certain operations. The operations can include, but are not limited to, the following: terminating or suspending automatic dispensing operations; releasing the latch mechanism locking the lid in its closed position; and/or outputting an indicator to a user of the VPA indicating that the roll needs to be replaced. After replacement of the roll, the automatic dispensing operations can be re-started.

Figure 4:
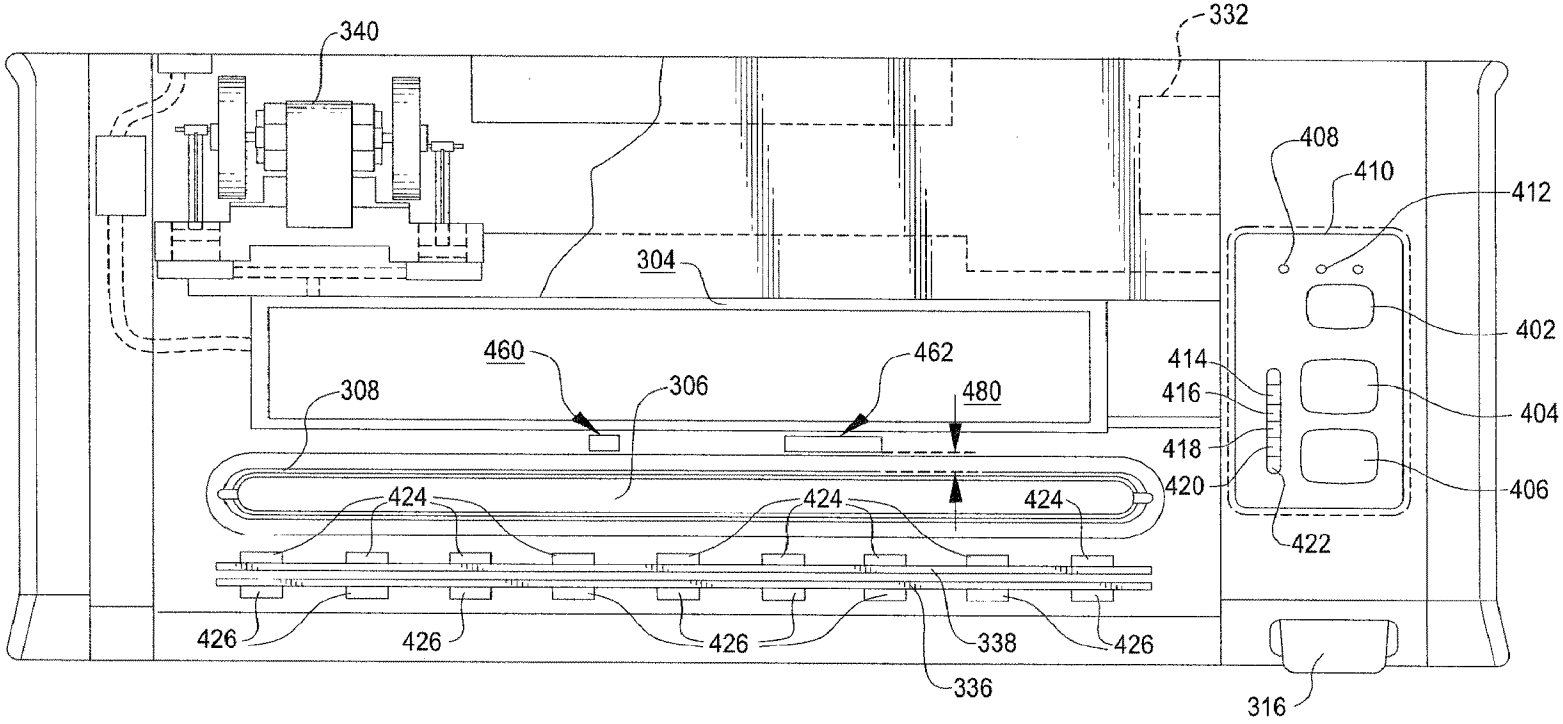
FIG. 4 is a top view of the VPA of FIGS. 2-3 with the lid removed and a portion of a base cutaway.
Figure 5:
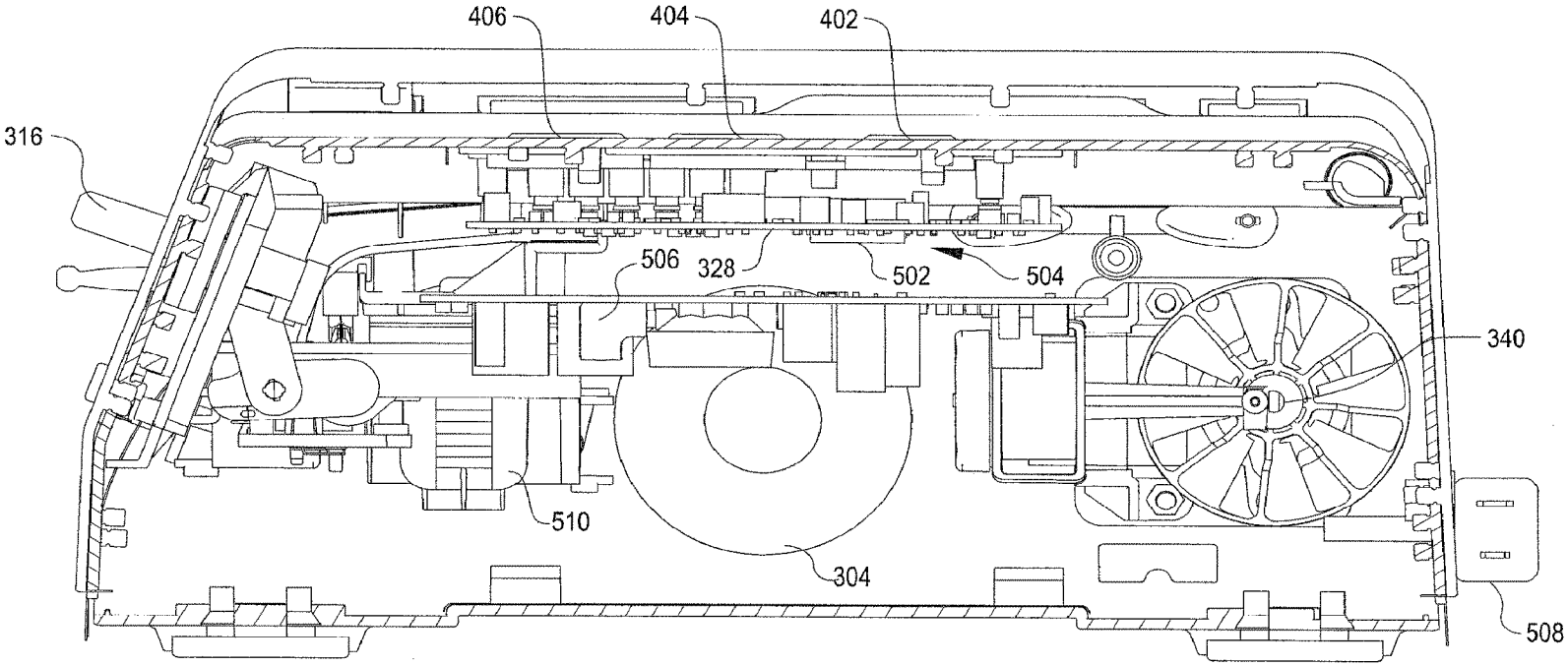
FIG. 5 is a cross-section of the VPA of FIGS. 2-4.
Figure 6:
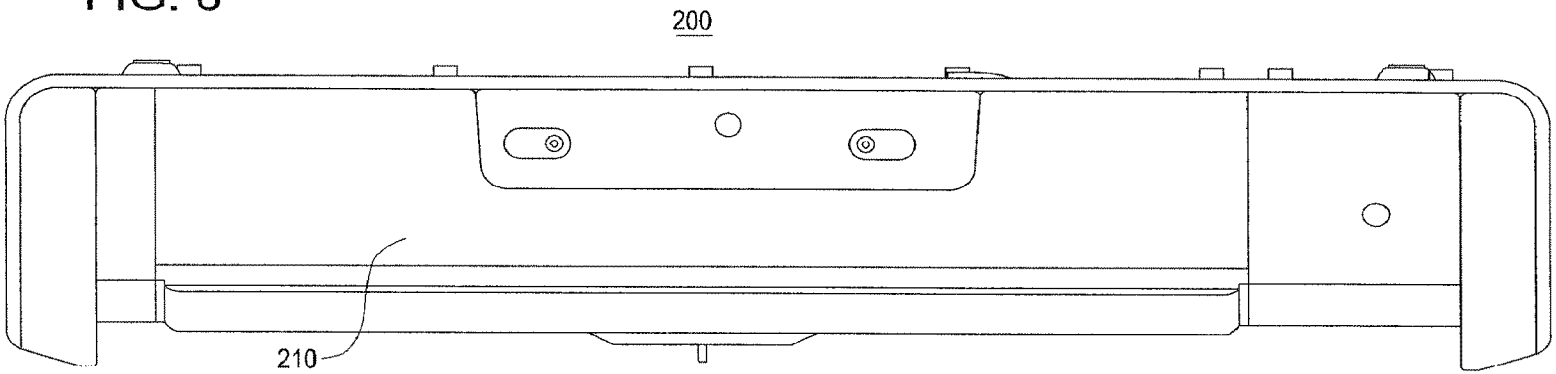
FIG. 6 is a rear view of the VPA of FIGS. 2-5.

In some scenarios, the proximity sensor mechanism 460, 462 is disposed between the roll 304 and a vacuum trough of the VPA, as shown in FIG. 4. The present invention is not limited in this regard. For example, the proximity sensor mechanism 460, 462 alternatively or additionally can be at least partially disposed between a front panel/surface of the VPA and the vacuum trough.

Next, the proximity sensor mechanism 460, 462 can be used to determine whether the dispensed container material is in a proper position within the VPA (i.e., determine that the container material is not folded or wrinkled). If it is determined that the dispensed container material is properly positioned within the VPA, then a clamping mechanism can be actuated for purposes of clamping the dispensed container material in position.

The section of clamped container material may then be cut from the roll 304. The cutting is achieved using a cutting device 204 integrated within the VPA 200. Such cutting device arrangements are well known in the art, and therefore will not be described in detail herein. Still, it should be understood that the cutting device 204 is moveably disposed within a track 206 formed in the pivoting lid 202 of the VPA 200. Any container material disposed below the cutting device 204 can be cut simply by sliding the cutting device 204 back and forth (or right and left) as shown by arrow 208 within the track 206.

In some scenarios, the above detection(s) by the proximity sensor mechanism 460, 462 can trigger certain mechanical and/or electronic operations by the VPA for facilitating the cutting of the dispensed container material. For example, a locking mechanism (not shown) may be released thereby allowing the cutting device 204 to be actuated automatically or manually. Additionally or alternatively, the cutting device 204 can be lowered into position via a lowering mechanism (not shown for ease of explanation) in response to said detection. Such lowering mechanisms are well known in the art, and therefore will not be described herein. Still, it should be understood that the lowering mechanism can include, but is not limited to, an inflatable bladder, a pneumatic cylinder, a hydraulic cylinder, resilient members, and/or electromagnets.

Next, the cut section of container material is used to form a partially sealed container into which perishables or other products (e.g., items 112 of FIG. 1) can be disposed. In this regard, the VPA 200 is used to form a seal (e.g., seal 104 of FIG. 1) in an open end of the cut section of container material.

The seal is formed using a sealing mechanism of the VPA 200. The sealing mechanism comprises a bumper 334 and at least one heat sealing strip 336, 338. At least one of the components 334-338 of the sealing mechanism can be retractable for various reasons. Still, at this time it should be understood that the bumper 334 is disposed on the pivoting lid 202 and the heat sealing strip 336, 338 is disposed on the base 210 of the VPA 200. Embodiments of the present invention are not limited in this regard. For example, the bumper 334 can alternatively be disposed on/in the base, while the heat sealing strip 336, 338 is disposed on/in the pivoting lid 202. In all cases, the bumper 334 and heat scaling strip 336, 338 are arranged to mate against each other when the lid 202 is in its closed position and a heat seal is to be formed. In effect, the open end of the container material can be sandwiched between elements 334, 336, 338 of the sealing mechanism. Thereafter, heat can be applied to the open end of the container material via the heat sealing strip 336, 338 so as to form a heat seal (e.g., seal 110 of FIG. 1) thereon.

After the perishables or other products have been disposed within the partially sealed container, the remaining open end of the partially sealed container is placed within the VPA 200. Next, the lid 202 is once again transitioned into its locked closed position. Thereafter, the proximity sensor mechanism 460, 462 can detect when the remaining open end of the partially sealed container is disposed properly within the VPA so as to at least partially protrude into a lower vacuum trough 306. Upon such detection, mechanical clamping operations and/or vacuum operations of the VPA 200 can be triggered.

The vacuum operations performed by the VPA 200 involve evacuating excess moisture and air from the interior of the partially sealed container. The evacuation of excess moisture and air is achieved using at least one vacuum pump (not shown) and a sealed vacuum chamber. The evacuation of moisture and air from the container minimizes the spoiling effects of oxygen on perishables and other products. Once a predetermined pressure is reached in the vacuum chamber as measured by a pressure sensor 506, a seal (e.g., seal 110 of FIG. 1) is formed along the remaining open end of the partially sealed container inserted into the VPA 200, whereby a hermetically sealed container is provided which retains the freshness of the contents thereof.

The sealed vacuum chamber is thrilled by elements of the base 210 and lid 202. More specifically, the base 210 comprises the lower vacuum trough 306 and a gasket 308. Similarly, the pivoting lid 202 comprises an upper vacuum trough 310 and a gasket 312. The troughs 306, 310 and gaskets 308, 312 are arranged to be respectively vertically and horizontally aligned with each other when the lid 202 is in its closed position so as to form a composite sealed vacuum chamber.

A Vacuum Motor Assembly ("VMA") 340 is disposed in the base 210 behind the lower vacuum trough 306 for providing evacuating suction within the sealed vacuum chamber. Once a predetermined pressure is reached in the vacuum chamber as measured by a pressure sensor 506, current can be applied to the heat sealing strip(s) 336, 338 for heating the same to a specified temperature (e.g., 160° C. to 200° C.). Notably, in some scenarios, the vacuum operations are not completed until some specified time after formation of the seal. This ensures that any additional food or moisture between the two film layers between the newly formed seal and respective open end of the container are removed.

The forgoing vacuum and sealing operations are controlled by the user through use of a control panel 326, in some scenarios, the control panel 326 is only operative when the lid 202 is in its locked closed position. The control panel 326 is disposed on the base 210 so as to be directly adjacent to the lid 202 when it is in the closed position, as shown in FIG. 2. The control panel 326 comprises electronic control circuitry 504. The electronic control circuitry 504 may be at least partially disposed on a circuit board 328. The circuit board 328 is located directly beneath the user interface 330 of the control panel 326.

The electronic control circuitry 504 is electrically connected to the VMA 340, sealing mechanism 334-338, proximity sensor mechanism 460, 462 and/or power circuit of the VPA 200. Operations of some or all of these components 332-340, 460, 462 are controlled by the electronic control circuitry 504. In this regard, the electronic control circuitry 504 can include, but is not limited to, a microprocessor 502, a system bus, a memory, a system interface and/or other hardware/software elements. The memory can comprise volatile memory and non-volatile memory. Various types of information can be stored in the memory. Such information includes, but is not limited to, processing results, control programs, parameter values, and/or measurement values.

The other hardware elements may comprise, but are not limited to, temperature sensors 424, 426. The temperature sensors 424, 426 are disposed adjacent to or in proximity to the heat sealing strip(s) 336, 338, respectively. In some scenarios, the temperature sensors 424, 426 are located at various locations along the entire length of the heat sealing strip 336, 338. In other scenarios, the temperature sensors can alternatively or additionally be disposed on the length of the bumper 334.

The temperature sensors 424, 426 are provided to continuously or periodically measure the temperature of the heat sealing strip(s) 336, 338. Such temperature detection can be used to ensure that the proper sealing temperature is being applied along the entire width of the container during the heat sealing process, as well as optionally control when the heat sealing strips are raised and/or lowered. In this regard, measurement values output from the temperature sensors 424, 426 are communicated to the electronic control circuitry 504 for further processing. For example, the microprocessor 502 may be configured to determine a mean average temperature of the heat sealing strip(s) 336, 338 and adjust current output thereto accordingly. Current can be applied to the heat sealing strip(s) 336, 338 for a predetermined period of time such that the temperature thereof is sufficient for forming a seat on an open end of a container.

The other hardware elements may also comprise a liquid level sensor 510. The liquid level sensor 510 is configured to detect an amount of accumulated liquid in a drip tray 350 of the VPA 200. The drip tray 350 rests in the lower vacuum trough 306 during operation of the VPA 200 for collecting excess liquids evacuated from the container (e.g., container 100 of FIG. 1). The drip tray 350 can be removed from the lower vacuum trough 306 so that the evacuated liquid can be discarded. The liquid level sensor 510 facilitates a determination by the electronic control circuitry 504 as to when the excess liquid should be removed. In this regard, the output of the liquid level sensor 510 is communicated to the electronic control circuitry 504 for further processing. This processing involves analyzing the output of the liquid level sensor 510 to detect when the liquid in the drip tray 350 exceeds a particular threshold level. When this condition exists, the electronic control circuitry 504 may perform operations to temporarily disable the VMA 340 and heat sealing elements 336, 338, as well as indicate to the user that the excess liquid should be removed from the drip tray 350. Once the excess liquid is removed, the VIVA 340 and heat sealing elements 336, 338 are once again enabled.

The user interface 330 can include, but is not limited to, switches 402-406, Light Emitting Diodes ("LEDs") 408-422, and/or a display screen (not shown). One or more of the switches can be a power switch configured to enable the turning on and/or off of the VPA 200. When the power switch is in its "turned on" position, power is supplied to the electronic control circuitry 504 from a power circuit of the VPA 200 (e.g., transformer 332 and/or a battery). The power circuit can include an internal power source (e.g., a battery) or a plug 508 for connecting the VPA 200 to an external power source (e.g., a wall mount socket).

One or more of the switches 402-406 can be configured to enable a user to control the heat sealing operations. The same or different switch 402-406 can be configured to control the vacuum operations. For example, in some scenarios, it may be desirable to commence only the heat sealing operations for sealing an open end of the container material after being cut and prior to being filled with perishables or other products. Additionally, it may be desirable to commence: the vacuum operations once the perishables or other products have been inserted into the partially sealed container; and the heat sealing operations subsequent to the evacuation of at least some fluid from the interior of the container during the vacuum operations. One or more of the LEDs 408-422 or other indicia of the control panel 326 can be used to indicate to the user when the heat sealing operations and/or the vacuum operations are being performed and/or have been completed. For example, an LED may emit red light when the heat sealing operations are being performed. Once the heat sealing operations are completed, the LED can cease emitting light.

As noted above, a proximity sensor mechanism 460, 462 is provided for detecting pre-defined conditions. For example, the proximity sensor mechanism 460, 462 is configured to detect when a container material is disposed below the cutting device 204 and/or for detecting when an open end of a partially sealed container is disposed within the VPA 200 so as to at least partially protrude into a lower vacuum trough 306. In response to detecting at least one pre-defined condition, certain mechanical and/or electronic operations of the VPA 200 can be triggered and/or performed. For example, one or more of the following operations can be triggered in response to said detection: terminating or suspending automatic dispensing operations of a VPA; releasing a locking mechanism so as to allow the cutting device to be actuated automatically or manually; lowering the cutting device into position via a lowering mechanism; initiating clamping operations by the VPA; initiating vacuum operations by the VPA; and/or initiating heat sealing operations by the VPA.

Figure 7:
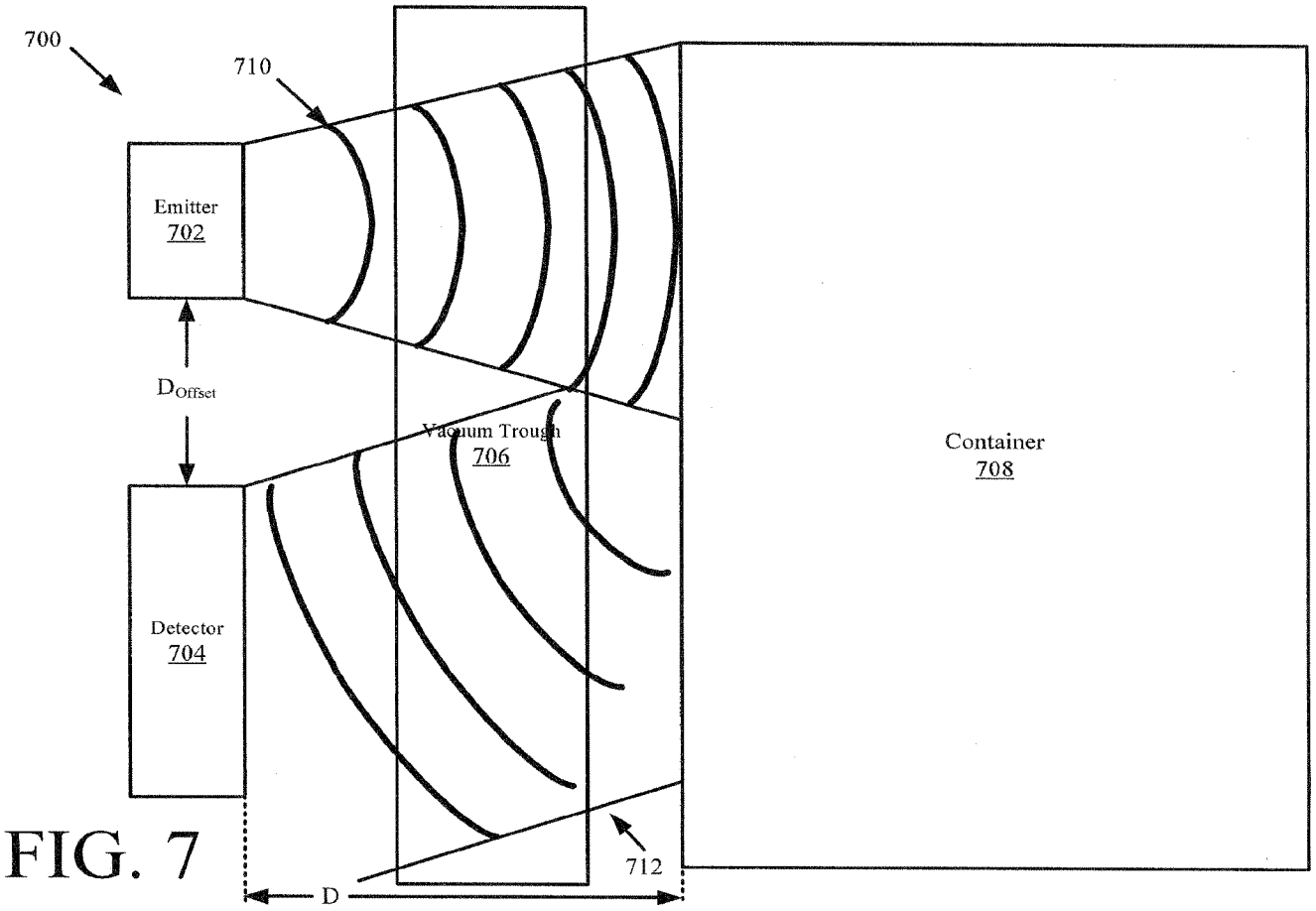
FIG. 7 is a schematic illustration that is useful in understanding exemplary operations of a proximity sensor mechanism.

Referring now to FIG. 7, there is provided a schematic illustration of an exemplary proximity sensor mechanism 700 that is useful for understanding the present invention. Proximity sensor mechanism 700 is generally configured to detect the presence of a nearby object without any physical contact therewith. The object can include, but is not limited to, at least a portion of a sealed or partially sealed container. The object being sensed is also referred to herein as the proximity sensor mechanism's target. Different proximity sensor mechanism targets demand different types of sensors.

For example, if the container material is plastic, then the sensors may comprise a photoelectric sensor. In this case, the proximity sensor mechanism 700 comprises an emitter 702 and a detector 704. The emitter 702 is configured to emit an electromagnetic radiation (infrared, for instance) 710. The detector 704 is configured to detect any changes in the field or return signal 712. Such emitters and detectors are well known in the art, and therefore will not be described herein. However, the specific use of such emitters and detectors as described herein is not known in the art, and therefore is novel.

The sensor arrangement shown in FIG. 7 is a retro-reflective arrangement. Accordingly, the emitter 702 and the detector 704 are placed at approximately the same horizontal distance D (e.g., distance 480 of FIG. 4) from the lower vacuum trough 306. The emitter 702 and detector 704 are also offset from one another by a distance $D_{Offset}$. Embodiments of the present invention are not limited to this particular arrangement of the emitter and detector. Other arrangements can be used which are suitable for a particular application.

As noted above, the detector 704 is configured to detect light reflected off of a container 708. In the VPA scenario, the container 708 is disposed within a lower vacuum trough (e.g., lower vacuum trough 306 of FIG. 3) thereof. Therefore, in order to allow such detection, the lower vacuum trough is formed of a transparent material through which light (e.g., infrared light) can pass, such as clear plastic.

The detection of light reflected off of a container by the detector 704 will trigger the performance of certain operations by a VPA (e.g., VPA 200 of FIG. 2). For example, upon the detection of reflected light, the proximity sensor mechanism 700 generates and communicates a signal to the electronic control circuitry (e.g., electronic control circuitry 504 of FIG. 5). In turn, the electronic control circuitry causes: (1) automatic dispensing operations of the VPA to be terminated or suspended; (2) a locking mechanism to be released so as to allow the cutting device to be actuated automatically or manually; (3) a cutting device (e.g., cutting device 204 of FIG. 2) to be lowered into position via a lowering mechanism; (4) clamping operations to be initiated; (5) vacuum operations to be initiated; and/or (6) heat sealing operation to be initiated.

Figure 8:
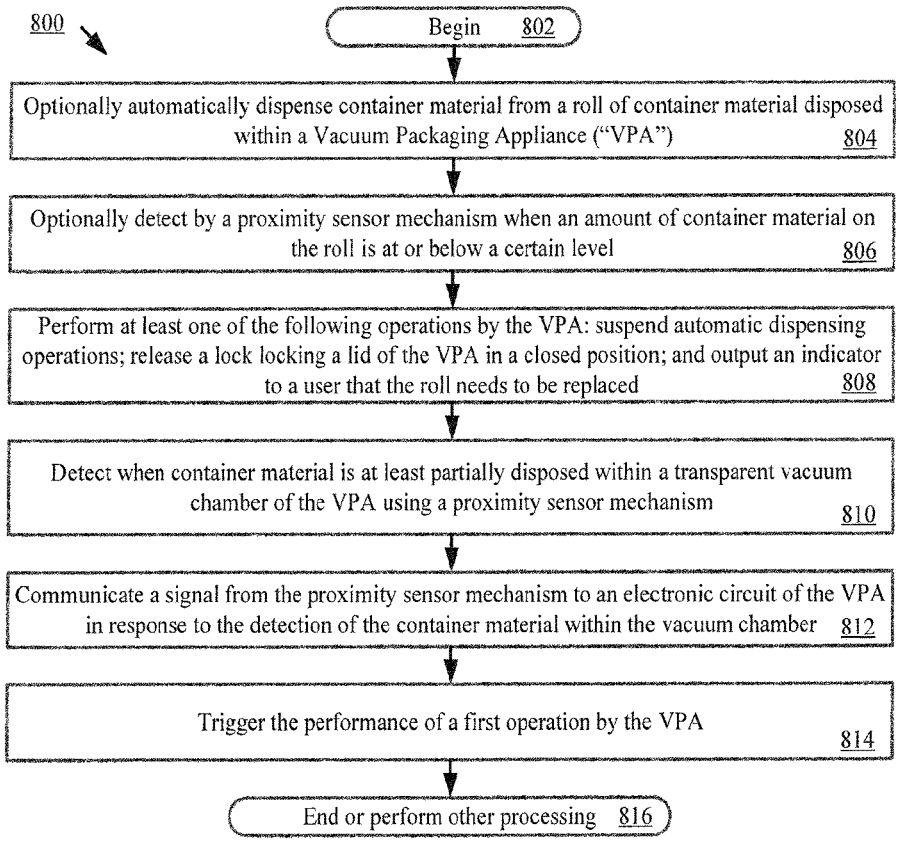
FIG. 8 is a flow diagram of an exemplary method for causing certain operations to be performed by a VPA.

Referring now to FIG. 8, there is provided a flow diagram of an exemplary method. 800 for causing certain operations to be performed by a VPA (e.g., VPA 200 of FIG. 2). Method 800 can include more or less steps than those shown in FIG. 8. For example, the VPA may have an automatic dispensing feature. In this case, method 800 may comprise optional steps 804-808. If the VPA does not have such an automatic dispensing feature, then method 800 can be absent of optional steps 804-808.

Referring again to FIG. 8, method 800 begins with step 802 and continues with optional step 804 where container material is automatically dispensed from a roll of container material disposed in the VPA. Next in step 806, a proximity sensor mechanism detects when an amount of container material contained on the roll is at or below a certain level. When such detection is made (as shown by step 808), at least one of the following operations can be performed by the VPA; suspend automatic dispensing operations; release a lock locking a lid of the VPA in a closed position; and output, an indicator to a user that the roll needs to be replaced.

The proximity sensor mechanism can perform other detection operations, as shown by step 810. In step 810, the proximity sensor mechanism detects when container material is at least partially disposed within a transparent vacuum chamber of the VPA using a proximity sensor mechanism. This detection can be performed in response to a lid of the VPA being locked in a closed position. In a next step 812, a signal is communicated from the proximity sensor mechanism to an electronic circuit of the VPA in response to the detection of the container material within the vacuum chamber. Thereafter, the performance of a first operation by the VPA is triggered, as shown by step 814. The first operation can be selected from the group comprising at least one of: mechanical clamping operations to clamp the container material in position; vacuum operations to extract fluid from within a container defined by the container material; heat sealing operations to create a heat seal along an open end of the container; lock releasing operations to allow actuation of a cutting device; and lowering operations to transition a cutting device from a retracted position into a cutting position. Upon completing step 814, step 816 is preformed where method 800 ends or other processing is performed.

In these and other scenarios, the proximity sensor mechanism may be disposed within the VPA at a location (1) between a roll of container material and a vacuum trough or (2) between a front panel and the vacuum trough. Additionally, the proximity sensor mechanism can comprise: an emitter configured to emit light in proximity to and in a direction towards a vacuum chamber of the VPA; and a detector configured to detect the light reflected from the container material disposed in the VPA Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

I claim:

1. A method for causing certain operations to be performed by a Vacuum Packaging Appliance ("VPA"), comprising:

detecting when a container material is at least partially disposed within a vacuum chamber of the VPA using a proximity sensor mechanism;

communicating a signal from the proximity sensor mechanism to an electronic circuit of the VPA in response to the detection of the container material within the vacuum chamber;

triggering a performance of a first operation by the VPA in response to the reception of the signal by the electronic circuit, where the first operation is selected from the group comprising mechanical clamping operations to clamp the container material in position, vacuum operations to extract fluid from within a container defined by the container material, and heat sealing operations to create a heat seal along an open end of a container; and detecting by the proximity sensor mechanism when an amount of container material contained on a roll disposed within the VPA is at or below a certain level.

2. The method according to claim 1, wherein the detecting step is performed in response to a lid of the VPA being locked in a closed position.

3. The method according to claim 1, further including automatically dispensing container material from a roll of container material disposed in the VPA.

4. The method according to claim 1, further including performing at least one of the following operations in response to the detection that the amount of container material contained on the roll is at or below the certain level:

suspend automatic dispensing operations; and release a lock locking a lid of the VPA in a closed position.

5. The method according to claim 1, wherein the group from which the first operation is selected further comprises at least one of:

lock releasing operations to allow actuation of a cutting device; and lowering operations to transition a cutting device from a retracted position into a cutting position.

6. The method according to claim 1, wherein the proximity sensor mechanism is disposed within the VPA at a location (1) between a roll of container material and a vacuum trough or (2) between a front panel and the vacuum trough.

7. The method according to claim 1, further including emitting light in proximity to and in a direction towards a vacuum chamber of the VPA.

8. The method according to claim 7, further including detecting the light reflected from the container material disposed in the VPA.

9. A Vacuum Packaging Appliance ("VPA"), comprising:

a proximity sensor mechanism configured to (1) detect when container material is at least partially disposed within a vacuum chamber of the VPA, and (2) communicate a signal to an electronic circuit of the VPA in response to the detection of the container material within the vacuum chamber;

the electronic circuit configured to trigger a performance of a first operation by the VPA in response to the reception of the signal from the proximity sensor mechanism, where the first operation is selected from the group comprising mechanical clamping operations to clamp the container material in position, vacuum operations to extract fluid from within a container defined by the container material, and heat sealing operations to create a heat seal along an open end of the container; and wherein the proximity sensor mechanism is further configured to detect when an amount of container material contained on a roll disposed within the VPA is at or below a certain level.

10. The VPA according to claim 9, wherein the proximity sensor mechanism performs detecting operations in response to a lid of the VPA being locked in a closed position.

11. The VPA according to claim 9, wherein the electronic circuit is further configured to automatically dispense container material from a roll of container material disposed in the VPA.

12. The VPA according to claim 9, wherein the electronic circuit performs at least one of the following operations in response to the detection that the amount of container material contained on the roll is at or below the certain level;

suspend automatic dispensing operations; and release a lock locking a lid of the VPA in a closed position.

13. The VPA according to claim 9, wherein the group from which the first operation is selected further comprises at least one of:

lock releasing operations to allow actuation of a cutting device; and lowering operations to transition a cutting device from a retracted position into a cutting position.

14. The VPA according to claim 9, wherein the proximity sensor mechanism is disposed within the VPA at a location (1) between a roll of container material and a vacuum trough or (2) between a front panel and the vacuum trough.

15. The VPA according to claim 9, wherein the proximity sensor mechanism includes an emitter configured to emit light in proximity to and in a direction towards a vacuum chamber of the VPA.

16. The VPA according to claim 15, wherein the proximity sensor mechanism further includes a detector configured to detect the light reflected from the container material disposed in the VPA.

* * * * *